US010214271B1

(12) United States Patent
Gonring et al.

(10) Patent No.: US 10,214,271 B1
(45) Date of Patent: Feb. 26, 2019

(54) SYSTEMS AND METHODS FOR MONITORING UNDERWATER IMPACTS TO MARINE PROPULSION DEVICES

(71) Applicant: Brunswick Corporation, Lake Forest, IL (US)

(72) Inventors: Steven J. Gonring, Slinger, WI (US); Mark D. Curtis, West Bend, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/277,419

(22) Filed: Sep. 27, 2016

(51) Int. Cl.

| | |
|---|---|
| ***B63H 21/22*** | (2006.01) |
| ***B63H 23/00*** | (2006.01) |
| ***B63H 5/125*** | (2006.01) |
| ***B63H 20/08*** | (2006.01) |
| ***B63H 21/21*** | (2006.01) |
| ***B63H 20/10*** | (2006.01) |
| ***B63H 21/14*** | (2006.01) |
| *B63J 99/00* | (2009.01) |

(52) U.S. Cl.
CPC ..... *B63H 21/21* (2013.01); *B63H 20/10* (2013.01); *B63H 21/14* (2013.01); *B63H 2021/216* (2013.01); *B63J 2099/006* (2013.01)

(58) Field of Classification Search
CPC ..... B63H 20/10; B63H 2020/10
USPC ..... 440/1, 61 T
See application file for complete search history.

(56) References Cited

U.S. PATENT DOCUMENTS

| | | | | |
|---|---|---|---|---|
| 2,975,750 A * | 3/1961 | Smith | B63H 20/10 440/56 |
| 4,005,674 A | 2/1977 | Davis | |
| 4,318,699 A | 3/1982 | Wenstadt et al. | |
| 4,734,065 A * | 3/1988 | Nakahama | B63H 20/10 440/1 |
| 4,861,291 A * | 8/1989 | Koike | B63H 20/10 440/1 |
| 4,872,857 A | 10/1989 | Newman et al. | |
| 4,931,025 A * | 6/1990 | Torigai | G05D 1/0875 440/1 |
| 4,955,831 A * | 9/1990 | Inoue | B63H 21/265 440/1 |
| 5,067,919 A * | 11/1991 | Okita | B63H 21/265 440/61 C |
| 5,645,009 A * | 7/1997 | Lexau | B63H 21/265 114/274 |
| 6,109,986 A | 8/2000 | Gaynor et al. | |
| 6,179,673 B1 * | 1/2001 | Leroux | B63H 20/106 440/65 |
| 6,200,177 B1 | 3/2001 | Scott et al. | |
| 6,273,771 B1 | 8/2001 | Buckley et al. | |

(Continued)

*Primary Examiner* — Daniel V Venne
(74) *Attorney, Agent, or Firm* — Andrus Intellectual Property Law, LLP

(57) ABSTRACT

Systems and methods are for monitoring underwater impacts to marine propulsion devices. The systems can comprise a marine propulsion device that is trimmable up and down about a trim axis; a trim sensor that senses at least one of a current trim position of the marine propulsion device relative to the trim axis and a rate at which the marine propulsion device is trimmed relative to the trim axis; and a controller that is configured to compare the rate at which the marine propulsion device is trimmed relative to the trim axis to a stored threshold value to thereby determine whether an underwater impact to the marine propulsion device has occurred.

13 Claims, 5 Drawing Sheets

(56) References Cited

U.S. PATENT DOCUMENTS

| | | | | |
|---|---|---|---|---|
| 6,322,404 | B1 | 11/2001 | Magee et al. | |
| 6,752,672 | B2 | 6/2004 | Kanno | |
| 7,156,709 | B1 | 1/2007 | Staerzl et al. | |
| 7,416,456 | B1 * | 8/2008 | Gonring | B63H 20/10 440/1 |
| 8,622,777 | B1 | 1/2014 | McNalley et al. | |
| 9,290,252 | B1 * | 3/2016 | Tuchscherer | B63H 20/08 |
| 9,381,989 | B1 | 7/2016 | Poirier | |
| 9,517,825 | B1 * | 12/2016 | Anschuetz | B63H 20/10 |

* cited by examiner

SYSTEMS AND METHODS FOR MONITORING UNDERWATER IMPACTS TO MARINE PROPULSION DEVICES

FIELD

The present disclosure relates to marine propulsion devices for propelling marine vessels, and particularly to systems and methods for monitoring underwater impacts to marine propulsion devices.

BACKGROUND

The following U.S. Patents are incorporated herein by reference, in entirety:

U.S. Pat. No. 4,005,674 discloses a pivot position sensor for sensing outboard motor trim, which includes a housing within which a pair of U-shaped movable contacts are secured in axially spaced relation on an operating rod which extends outwardly of the housing.

U.S. Pat. No. 4,318,699 discloses a sensor that responds to the operation of a marine transportation system to sense on-plane and off-plane conditions of a boat to operate a trim control to automatically position a trimmable drive for a desired boating operation.

U.S. Pat. No. 4,734,065 discloses arrangements for stabilizing the running of a marine propulsion device by slowing the speed of the propulsion unit when an underwater obstacle is struck.

U.S. Pat. No. 4,861,291 discloses embodiments of marine outboard drives including devices for protecting the unit in the event of tilting up more than a predetermined extent. The protection devices slow the engine when the outboard drive is tilted up more than the predetermined amount.

U.S. Pat. No. 4,872,857 discloses a system for optimizing the operation of a marine drive of the type whose position may be varied with respect to the boat by the operation of separate lift and trim/tilt means. The system includes an automatic control system which stores preselected drive unit positions for various operating modes and is operative to return the drive unit to any pre-established position by pressing a selected operating mode positioning button.

U.S. Pat. No. 6,109,986 discloses an idle speed control system for a marine propulsion system that controls the amount of fuel injected into the combustion chamber of an engine cylinder as a function of the error between a selected target speed and an actual speed. The speed can be engine speed measured in revolutions per minute or, alternatively, it can be boat speed measured in nautical miles per hour or kilometers per hour.

U.S. Pat. No. 6,200,177 discloses a marine propulsion system provided with a gear shifting apparatus and method that changes a transmission from a low gear to a high gear, and vice versa, based solely on the engine speed. Engine speed is measured and a rate of change of engine speed is determined as a function of the actual change in engine speed over a measured time interval.

U.S. Pat. No. 6,322,404 discloses a Hall-effect rotational position sensor that is mounted on a pivotable member of a marine propulsion system wherein a rotatable portion of the rotational position sensor is attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

U.S. Pat. No. 6,273,771 discloses a control system for a marine vessel that incorporates a marine propulsion system connected in signal communication with a serial communication bus and a controller. A plurality of input devices and output devices are also connected in signal communication with the communication bus. A bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,752,672 discloses a watercraft having an engine that is controlled to reduce the likelihood of engine damage when the watercraft engine speed is rapidly increased due to a lack of load on the propulsion unit. The engine is controlled by a method that detects engine speed and reduces the power output of the engine by varying degrees depending on the speed of the engine relative to plural predetermined speeds.

U.S. Pat. No. 7,156,709 discloses a calibration procedure that allows an upward maximum limit of tilt to be automatically determined and stored as an operator rotates a marine propulsion device relative to a marine vessel with a particular indication present. That indication can be a grounded circuit point which informs a microprocessor that a calibration procedure is occurring in relation to an upward trim limit. When the ground wire is removed or disconnected from the circuit point, the microprocessor knows that the calibration process is complete. During the rotation of the outboard motor or marine propulsion device in an upward direction, both the angular position of the outboard motor and the direction of change of a signal from a trim sensor are stored.

U.S. Pat. No. 8,622,777 discloses systems and methods for maneuvering a marine vessel so as to limit interference by the hull of the vessel with reverse thrust. A marine propulsion device provides at least a reverse thrust with respect to the marine vessel. The propulsion device is vertically pivotable into a trim position wherein the hull does not impede or interfere with the reverse thrust. A control circuit controls the propulsion device to move into the trim position when the reverse thrust of the propulsion device is requested.

U.S. Pat. No. 9,290,252 discloses systems and methods for controlling trim position of a marine propulsion device on a marine vessel. A trim actuator has a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, systems and methods are for monitoring underwater impacts to marine propulsion devices. The systems can comprise a marine propulsion device that is trimmable up and down about a trim axis; a trim sensor that senses at least one of (1) a current trim position of the marine propulsion device relative to the trim axis and (2) a rate at which the marine propulsion device is trimmed relative to the trim axis; and a controller that is configured to compare the rate at which the marine propulsion device is trimmed relative to the trim axis to a stored threshold value to thereby determine whether an underwater impact to the marine propulsion device has occurred. In certain examples, the systems include an internal combustion engine and the controller is further configured to shut down the engine when the underwater impact to the marine propulsion device is determined to have occurred.

In certain examples, the controller is configured to determine an estimated remaining useful life of the marine propulsion device by calculating an impact force on the marine propulsion device based upon the rate at which the marine propulsion device is trimmed relative to the trim axis, and then storing the impact force in a memory, summing the impact force with previous impact forces on the marine propulsion device, and comparing the resultant value to a stored threshold value. The controller can be configured to indicate to an operator or technician whether the marine propulsion device requires maintenance and/or replacement based upon the impact occurrence history.

BRIEF DESCRIPTION OF THE DRAWINGS

The present disclosure is provided with reference to the following drawing Figures. The same numbers are used throughout the drawing Figures to reference like features and like components.

DETAILED DESCRIPTION OF THE DRAWINGS

During research and experimentation, the present inventors have determined that it is desirable to provide improved systems and methods for detecting and/or monitoring impacts on marine propulsion devices, and particularly high-speed impacts on a gearcase and/or driveshaft housing associated with marine propulsion devices. Such impacts typically occur with underwater obstructions, such as logs, reefs, the seabed, and/or the like. The present inventors have also found that high-speed impacts with underwater obstructions can potentially cause serious damage to the marine vessel and possibly endanger passengers onboard the marine vessel. The inventors have therefore found it to be desirable to provide improved systems and methods for controlling operations of the marine propulsion device (for example shutting the device off) when a high-speed impact occurs—so as to prevent further damage to the marine vessel and to protect the occupants of the marine vessel from harm.

During research and experimentation, the present inventors have also determined that it is desirable to provide improved systems and methods for determining and/or predicting future maintenance and/or repair requirements for a marine propulsion device based on current and historical impact occurrences to the device. Multiple high-speed impacts from underwater obstructions can reduce the lifespan of components of the marine propulsion device. For example gearcase housings and/or driveshaft housings on marine propulsion devices are often constructed of relatively lightweight aluminum, which can have limited impact strength. If the aluminum is in use over a long enough period of time, under a given load, it will ultimately require repair or replacement. As such, the present inventors have found it to be desirable to provide systems and methods that determine and/or predict such future maintenance and/or replacement requirements of these aluminum components based on cumulative effects of current and historical impacts from underwater obstructions.

Figure 1:
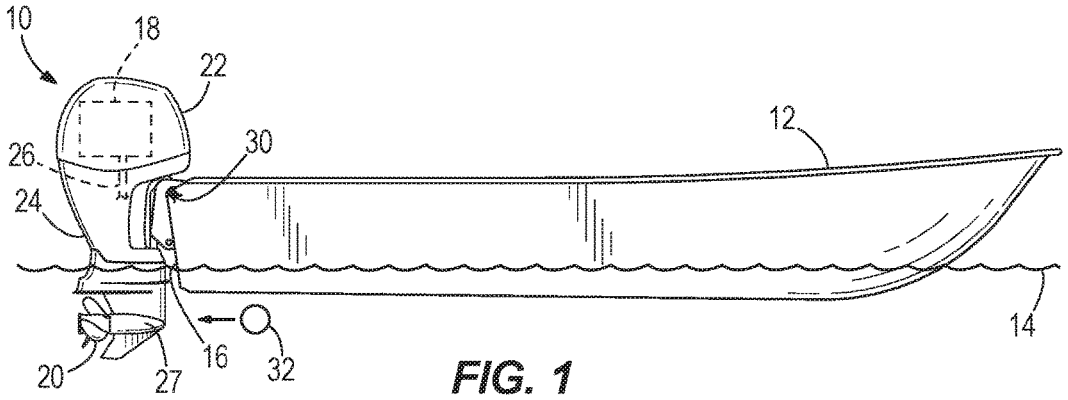
FIG. 1 is a schematic illustration of a marine vessel having a marine propulsion device in a trimmed down position. The marine vessel and marine propulsion device are approaching an underwater object.
Figure 2:
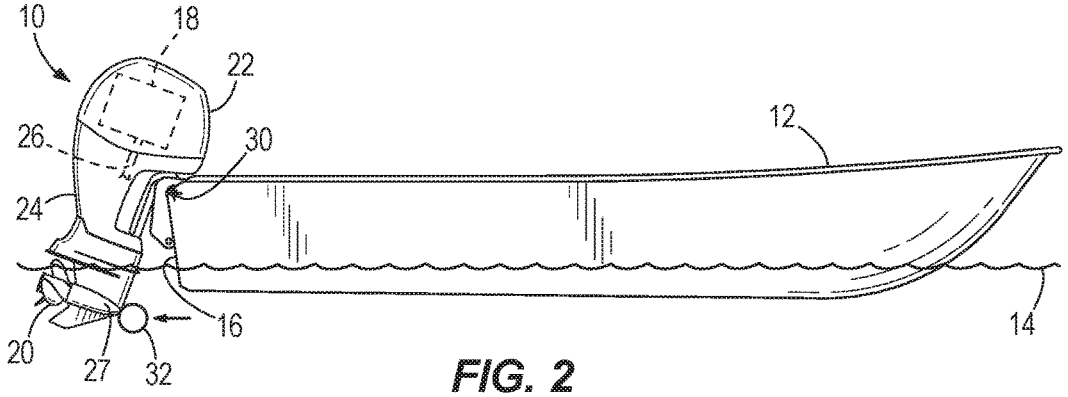
FIG. 2 is a schematic illustration of the marine propulsion device as it impacts the underwater object.
Figure 3:
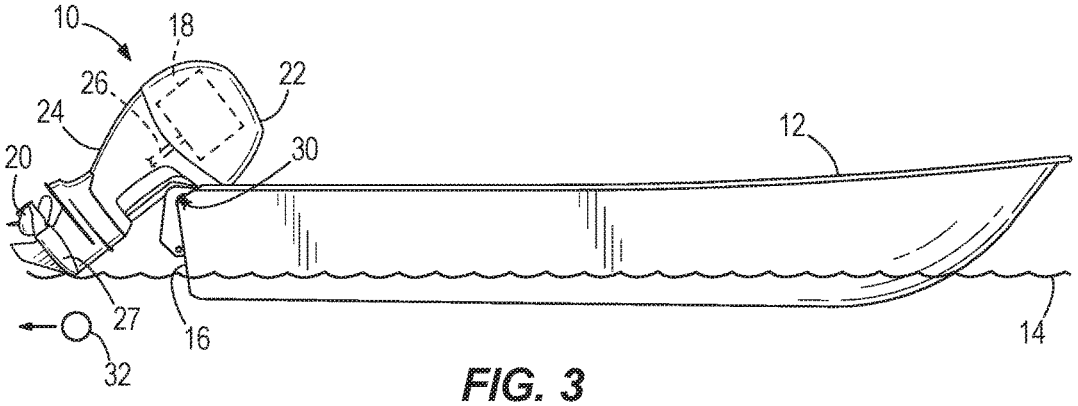
FIG. 3 is a schematic illustration of the marine propulsion device after it has impacted the underwater object. The impact has forced the marine propulsion device into a trimmed up position.

FIGS. 1-3 depict a marine propulsion device 10 that is configured (e.g. programmed) to propel a marine vessel 12 in a body of water 14. As is conventional, the marine propulsion device 10 is coupled to the transom 16 of the marine vessel 12 and has an internal combustion engine 18 that is operatively connected to a propulsor (in the illustrated example, a propeller 20), such that operation of the internal combustion engine 18 causes rotation of the propeller 20. Rotation of the propeller 20 generates a thrust force in the water 14, which propels the marine vessel 12. In the illustrated example, the marine propulsion device 10 is an outboard motor having an upper cowling 22 that covers the internal combustion engine 18, a driveshaft housing 24 located below the upper cowling 22, and a gearcase 27 located below the driveshaft housing 24. A driveshaft 26 extends from the internal combustion engine 18, through the driveshaft housing 24, to the gearcase 27, which contains a transmission (e.g. gears) for transmitting rotation of the driveshaft 26 to the propeller 20. As is conventional, the internal combustion engine 18 has an ignition system 21 (see FIG. 4) including for example, ignition coils and a fuel system 23 (see FIG. 4) including for example, fuel injectors. The ignition system 21 and fuel system 23 are configured to cause combustion in the internal combustion engine 18, which operates the noted driveshaft 26 and propeller 20, as described above. The marine propulsion device 10 can be connected to the transom 16 by a conventional transom bracket, which is configured to allow the marine propulsion device 10 to be trimmed (i.e. pivoted) up and down about a horizontal trim axis 30.

It should be understood that the type and configuration of the marine propulsion device 10 and the manner in which the marine propulsion device 10 is coupled to the transom 16 of the marine vessel 12 can vary from that which is shown. For example, instead of an outboard motor, the marine propulsion device 10 can include an inboard drive, an outboard drive, a so-called inboard/outboard drive, a sterndrive, a trolling motor, and/or the like. The marine propulsion device 10 can have any different type of propulsor, such as one or more propellers, counter rotating propellers, impellers, pod drives and/or the like. It should also be understood that the type and configuration of the marine vessel 12 is merely exemplary and can also widely vary from that which is shown.

FIG. 1 depicts the marine propulsion device 10 in a trimmed down position on the marine vessel 12. As is conventional, operation of the internal combustion engine 18 causes rotation of the driveshaft 26, which causes rotation of the set of gears (e.g. a transmission and/or clutch) in the gearcase 27, which causes rotation of the propeller 20. The gears in the gearcase can be configured to cause forward and reverse rotation of the propeller 20. Rotation of the propeller 20 in the body of water 14 causes movement of the marine vessel 12 based on the direction of rotation of the propeller 20 and the steering angle of the marine propulsion device 10. As shown in FIG. 1, the marine propulsion device 10 is operating in forward gear and the marine propulsion device 10 is steered forwardly, and thus the marine vessel 12 is heading forwardly towards an underwater obstruction 32. The type of underwater obstruction 32 can vary and for example include a log, a reef, the sea bottom, or any other underwater structure that can impact on the marine propulsion device 10 as the marine vessel 12 travels through the body of water 14. An impact occurrence between the underwater obstruction 32 and the marine propulsion device 10 is commonly referred to in the art as a "logstrike", regardless of the particular type of underwater structure that impacts the marine propulsion device 10.

FIG. 2 shows that a high-speed impact between the marine propulsion device 10 and the underwater obstruction 32 forces the marine propulsion device 10 to rapidly trim upwardly about the trim axis 30 (i.e. trim upwardly away from the trimmed-down position shown in FIG. 1) as the marine vessel 12 impacts and travels over the underwater obstruction 32. This is an forced/involuntary movement, caused by the impact occurrence. The extent to which and rate at which the marine propulsion device 10 is trimmed upwardly will vary depending upon various factors including the rate at which the marine vessel 12 is traveling in the body of water 14, the relative sizes of the marine propulsion device 10 and the underwater obstruction 32, whether the underwater obstruction 32 is securely fixed in place, and various other factors. FIG. 3 illustrates the marine propulsion device 10 in a fully trimmed up position, after the marine vessel 12 has impacted with and moved past the underwater obstruction 32.

Thus, as shown by comparison of FIGS. 1-3, a high-speed impact engagement of the marine propulsion device 10 with the underwater obstruction 32 can cause a forced/involuntary, rapid trimming action of the marine propulsion device 10 from the trimmed down position shown in FIG. 1 to the trimmed up position shown in FIG. 3. In certain instances, such impact engagement can damage the marine propulsion device 10 to an extent which the marine propulsion device 10 requires immediate repair or replacement. Repeated impact engagements can also wear down certain components of the marine propulsion device 10, such as the gearcase and/or driveshaft housing described herein above, thus reducing the operative lifespan of these components.

Figure 4:
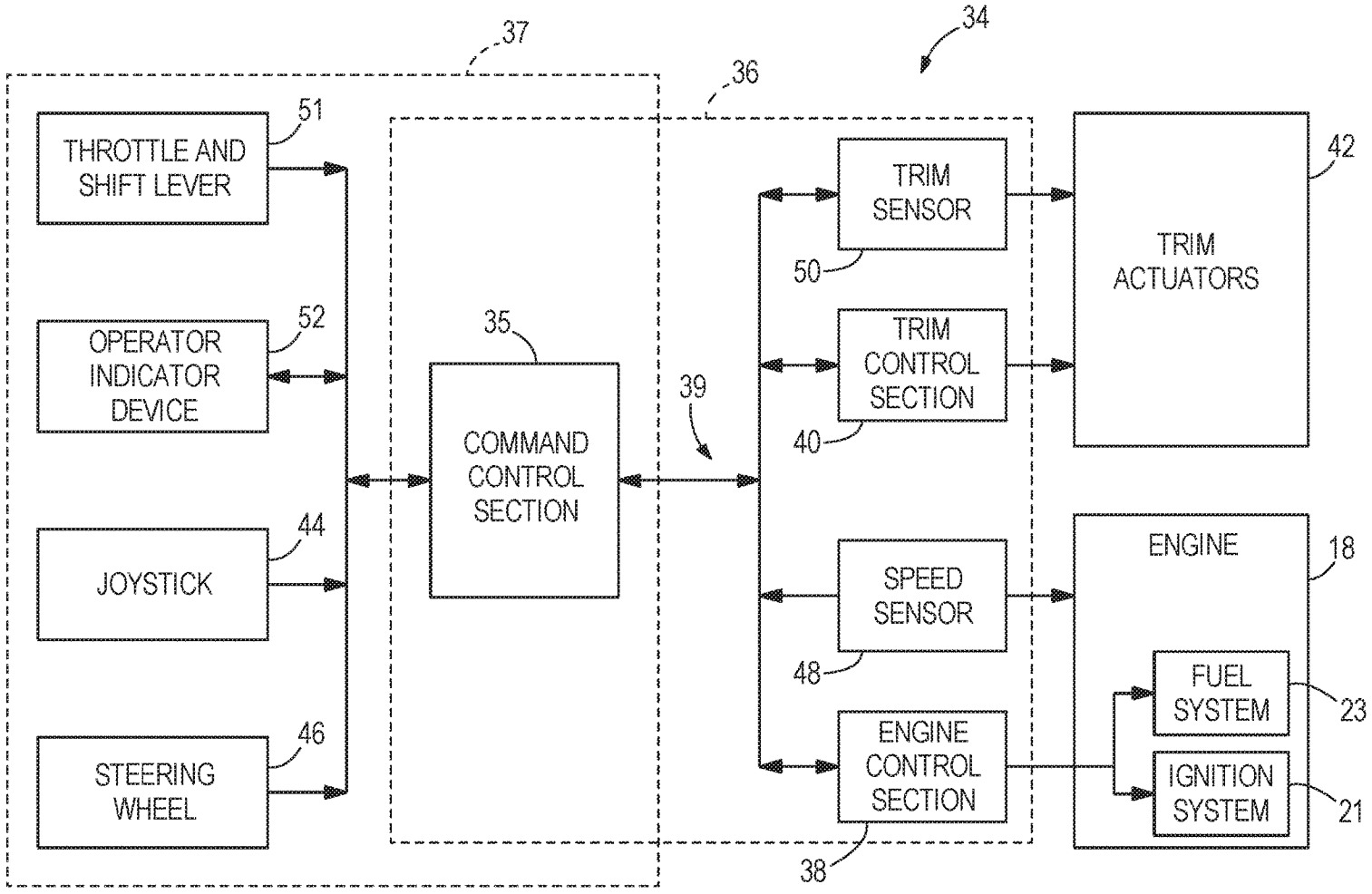
FIG. 4 is a schematic illustration of an exemplary system according to the present disclosure.

FIG. 4 depicts an exemplary system 34 according to the present disclosure for monitoring underwater impacts to the marine propulsion device 10. The system 34 includes a computer controller 36, which as further explained herein below is configured (e.g. programmed) to control various functions of the marine propulsion device 10, including for example the on/off state of the internal combustion engine 18, the speed of the internal combustion engine 18, and the trim position of the marine propulsion device 10. The controller 36 is shown in simplified schematic form and among other things includes a command control section 35 located at the helm 37 of the marine vessel 12. The command control section 35 has a processor and a memory and is configured to send and receive electronic signals via a communication link 39, to thereby communicate with an engine control section 38 associated with the marine propulsion device 10 and a trim control section 40 associated with conventional trim actuators 42 for changing the trim angle of the marine propulsion device 10. The communication link 39 can be a wired or wireless link, and in some examples can be part of a conventional controller area network (CAN), examples of which are disclosed in the above-incorporated U.S. Pat. No. 6,273,771. The engine control section 38 has a processor and a memory and is configured to send and receive electronic signals via the communication link 39 to thereby control the speed of the internal combustion engine 18 by, for example, controlling the noted ignition system 21 and fuel system 23. Computer (electronic) control of the speed of an internal combustion engine is well known in the art, as described in several of the above-incorporated patents, for example see U.S. Pat. No. 6,273,771, and thus is not further described herein. The trim control section 40 has a processor and a memory and is configured to send and receive electronic signals to thereby control the trim actuators 42, for example based upon operator inputs at the helm 37. The trim actuators 42 are conventional and for example can be electric motor driven and/or hydraulically driven. Trim actuators 42 and computer control of trim actuators 42 to thereby control trim angle of marine propulsion devices are well known in the art, as described in several of the above-incorporated patents, for example see U.S. Pat. No. 8,622,777, and thus are not further described herein. The system 34 further includes one or more conventional operator input devices, such as a joystick 44, a steering wheel 46, and/or a shift/throttle lever 49, each of which are configured to send electronic signals to the command control section 35. The type, number and location of the operator input devices can vary, and for example can be located at the helm 37 or remotely from the helm 37.

The system 34 also includes one or more conventional engine speed sensors 48 and one or more conventional trim sensors 50. Both the engine speed sensor 48 and the trim sensor 50 are configured to sense and communicate characteristics to the controller 36, for example via electronic signals. The engine speed sensor 48 and trim sensor 50 are convention items that are well-known in the art. Examples of suitable engine speed sensors and trim sensors are provided in the above-incorporated U.S. Patents. The type and configuration of the engine speed sensor 48 and trim sensor 50 can vary. In certain examples, the engine speed sensor 48 can be located on the crankshaft of the internal combustion engine 18. In certain examples, the engine speed sensor 48 can be, for example, one or more rotary and/or linear position sensors, including one or more tachometers, including but not limited to part numbers 864297 or 8M0011986 provided by Mercury Marine of Fond du Lac, Wisconsin. The type and configuration of the trim sensor 50 can be for example, a rotary or linear position sensor, for example a potentiometer, Hall Effect trim sender, and/or the like. In certain examples, the trim sensor 50 can be located on the trim actuator 42. In some examples, the trim sensor 50 is configured to sense the rate at which the marine propulsion device 10 is trimmed about the trim axis 30. In some examples, the trim sensor 50 is configured to sense a position of the marine propulsion device 10 with respect to the trim axis 30 and/or transom 16. Both types of trim sensors are conventional and are known in the art. Examples of trim sensors that could be used are provided by Mercury Marine of Fond du Lac, Wisconsin, part numbers 863187, 863187-1, 863187-A04, or 863187-A05.

Examples of programming and operations of the controller 36 are described in further detail herein below with respect to non-limiting examples and/or algorithms. While each of these examples/algorithms includes a specific series of steps for accomplishing certain system control functions, the scope of this disclosure is not intended to be bound by the literal order and literal content of these steps and non-substantial differences or changes fall within the scope of the disclosure.

As mentioned herein above, through research and experimentation, the present inventors have determined that it is desirable to identify an occurrence of an impact to the marine propulsion device 10 (e.g. a logstrike) to thereby prevent damage to the marine vessel and/or injury to the operator in the marine vessel 12. Most relevant to these purposes are impact occurrences that occur when the marine vessel 12 is traveling at relatively high speed. Through research and experimentation, the present inventors have determined that impact occurrences at high speeds typically cause the marine propulsion device 10 to involuntarily, rapidly trim upwardly away from the trimmed down position (FIG. 1) at a rate that is faster than the rate at which the trim actuators 42 is capable of (or would typically) trim the marine propulsion device 10, e.g., based upon inputs from the helm 37. Thus, the present inventors have determined that the rate at which the marine propulsion device 10 is forced to trim about the trim axis 30 provides an indication of whether an impact to the marine propulsion device 10 has occurred and also an indication of the force of the impact on the marine propulsion device 10.

According to some examples, based upon inputs from the trim sensor 50, the controller 36 is uniquely configured (e.g. programmed) to compare the rate at which the marine propulsion device 10 is trimmed relative to the trim axis 30 to a threshold value stored in the memory of the controller 36 (i.e. a "stored threshold value") to thereby determine whether an underwater impact to the marine propulsion device 10 has occurred. The "stored threshold value" can equate to the maximum speed at which the trim actuators 42 are capable of trimming the marine propulsion device 10 via the trim actuators 42. The "stored threshold value" can be selected/identified based upon trial and error with similar system configurations and/or calibrated at the time the system 34 is built. In some examples, the trim sensor 50 is configured to detect the rate at which the marine propulsion device 10 is trimmed relative to the trim axis 30 and communicate this information to the controller 36. In other examples, the trim sensor 50 is configured to detect the trim position of the marine propulsion device 10 at a first instant in time and then to detect the trim position of the marine propulsion device 10 at a later, second instant in time. Based upon the difference in positions at the first and second instants in time, and the difference in time between the first and second instants, the controller 36 can be configured to calculate the rate of change in trim position. The resultant of this calculation represents the rate at which the marine propulsion device 10 is currently trimmed relative to the trim axis 30. In both examples, if the rate at which the marine propulsion device 10 is trimmed relative to the trim axis 30 exceeds the stored threshold value, the controller 36 is configured to determine that the underwater impact to the marine propulsion device 10 has occurred.

Advantageously, when the controller 36 determines that an underwater impact to the marine propulsion device 10 has occurred, the controller 36 can be further configured to take action to prevent damage to the marine vessel 12 and/or injury to an operator. For example, the controller 36 can be configured, via the engine control section 38, shut down an operation of the internal combustion engine 18, for example the ignition system 21 and/or the fuel system 23, thus shutting down the internal combustion engine 18, which slows and/or stops rotation of the propeller 20.

In certain examples, the controller 36 can be further configured to control an operator indicator device 52 to thereby indicate to the operator that the impact has occurred. The type of operator indicator device 52 can vary and in certain examples can include a video screen or any other visual aide for visually indicating the impact occurrence to the operator and/or a speaker or other audio aide for audibly indicating the impact occurrence to the operator. Computer control of an operator indicator device is well known in the art and thus not further described herein.

In some examples, the controller 36 can be configured to determine whether the impact to the marine propulsion device 10 has occurred, not just based upon the rate at which the marine propulsion device 10 is trimmed relative to the trim axis 30, but also based upon one or more additional sensed conditions of the system 34. This can prevent or limit "false positives", i.e., where a rapid change in rate of trim is in fact not caused by an impact occurrence. For example, through research and experimentation, the present inventors have determined that when the marine propulsion device 10 is trimmed upwardly about the trim axis 30 into or past the fully trimmed up position shown in FIG. 3, the propeller 20 is typically moved up out of the body of water 14, which reduces resistance on the propeller 20 and allows the propeller 20 to rotate faster than it otherwise would when it is disposed in the body of water 14. That is, the body of water 14 provides more resistance to rotation of the propeller 20 than the air. Once the propeller 20 is removed from the water, it will inherently speed up. Such high speed impact occurrences that cause the propeller 20 to leave the body of water 14 could pose a serious risk to the safety to passengers on the marine vessel 12. Thus, the controller 36 can be configured to compare the current speed of the internal combustion engine 18, as sensed by the engine speed sensor 48, to a previous speed of the internal combustion engine 18, as sensed by the engine speed sensor 48. If the engine speed has changed by a stored threshold amount within a stored time period after the controller 36 determines that the marine propulsion device 10 has been trimmed relative to the trim axis 30, then the controller 36 is configured to determine that the propeller 20 has been forced out of the body of water 14 and an underwater impact to the marine propulsion device 10 has occurred. The stored time period can be a relatively short time period and can be a time period that is selected based on trial and error and programmed into the controller 36 by the manufacturer. The stored threshold amount can be determined by trial and error and/or calibrated at the time the system 34 is built.

In other examples, the present inventors have also determined that impact occurrences at high speed can also cause the marine propulsion device 10 to trim upwardly beyond a normal trim position range for that particular arrangement. The present inventors have determined that the position to which the marine propulsion device 10 is trimmed can provide an additional indication of whether an impact to the marine propulsion device 10 has occurred. Thus the controller 36 can be configured to determine that a high speed impact has occurred when both (1) the rate of trim of the marine propulsion device 10 is higher than the noted threshold value and (2) the trim position of the marine propulsion device 10 is outside of a stored "normal range" of trim positions for that particular arrangement. This combination can prevent or limit "false positive" readings, i.e., where a rapid change in rate of trim is in fact not caused by an impact occurrence.

In other examples, the controller 36 can be configured to require all three criteria (namely rate of trim, increase in speed of the internal combustion engine 18, and movement of the marine propulsion device 10 out of the stored normal range of trim position) for a determination that an impact has occurred.

As discussed herein above, the present inventors have also determined that it is desirable to provide improved systems and methods for determining and/or predicting future maintenance and/or repair requirements for a marine propulsion device based on current and historical impact occurrences to the device. In certain examples, the controller 36 can also or alternately be configured to calculate an impact force on the marine propulsion device 10 based upon the rate at which the marine propulsion device 10 is trimmed relative to the trim axis 30. For example, the memory of the controller 36 can be programmed with a look-up table that correlates rate of trim of the marine propulsion device 10 to impact force on the marine propulsion device 10. The correlation between rate of trim and force can be determined by historical data and experimentation (trial and error). For example, the present inventors have determined that the faster the marine propulsion device 10 is trimmed about the trim axis 30, the greater the impact on the marine propulsion device 10, and vice versa. Thus, the controller 36 can be configured to determine the impact force on the marine propulsion device 10 from a particular impact occurrence, store the new impact force in its memory, sum the new impact force with any previous impact forces that have already been stored in the memory of the controller 36, and then compare the resultant value to a stored threshold value—to thereby determine a remaining useful life of the marine propulsion device 10. The stored threshold value can be based upon particular physical characteristics of the marine propulsion device 10, for example based upon the durability of the marine propulsion device 10 (e.g. material of its construction, the manner of its construction, etc.) and/or based upon past experiences (e.g. trial and error) with similar configurations of marine propulsion devices.

In some examples, the manufacturer of the marine propulsion device 10 can estimate a total cumulative force limit that the marine propulsion device 10 could withstand before maintenance or repair likely will be needed. Based upon a comparison of the resultant value calculated by the controller 36 to the total cumulative force limit, the controller 36 can be configured to control the operator indicator device 52 to indicate a remaining useful life of the marine propulsion device 10. If the resultant value calculated by the controller 36 is greater than the stored value, the controller 36 can be further be configured to control the operator indicator device 52 to provide a recommendation for necessary service and/or replacement.

In some examples, the controller 36 can also be configured to require that the change of rate of trim occur for longer than a stored time correlated to the time a normal "trailover" event. The stored time can be a calibrated value based on trial and error and/or historical records. Thus in these examples, similar to the examples described herein above, the controller 36 is configured to ignore minor trailover impact occurrences, i.e., when a rapid change in rate of trim is in fact not caused by a severe, damaging impact occurrence. In some examples, the historical impact force data stored by the controller 36 can be provided to a servicing dealer when the marine propulsion device 10 is in for service. This can help the servicing dealer determine necessary maintenance and/or repair.

Figure 5:
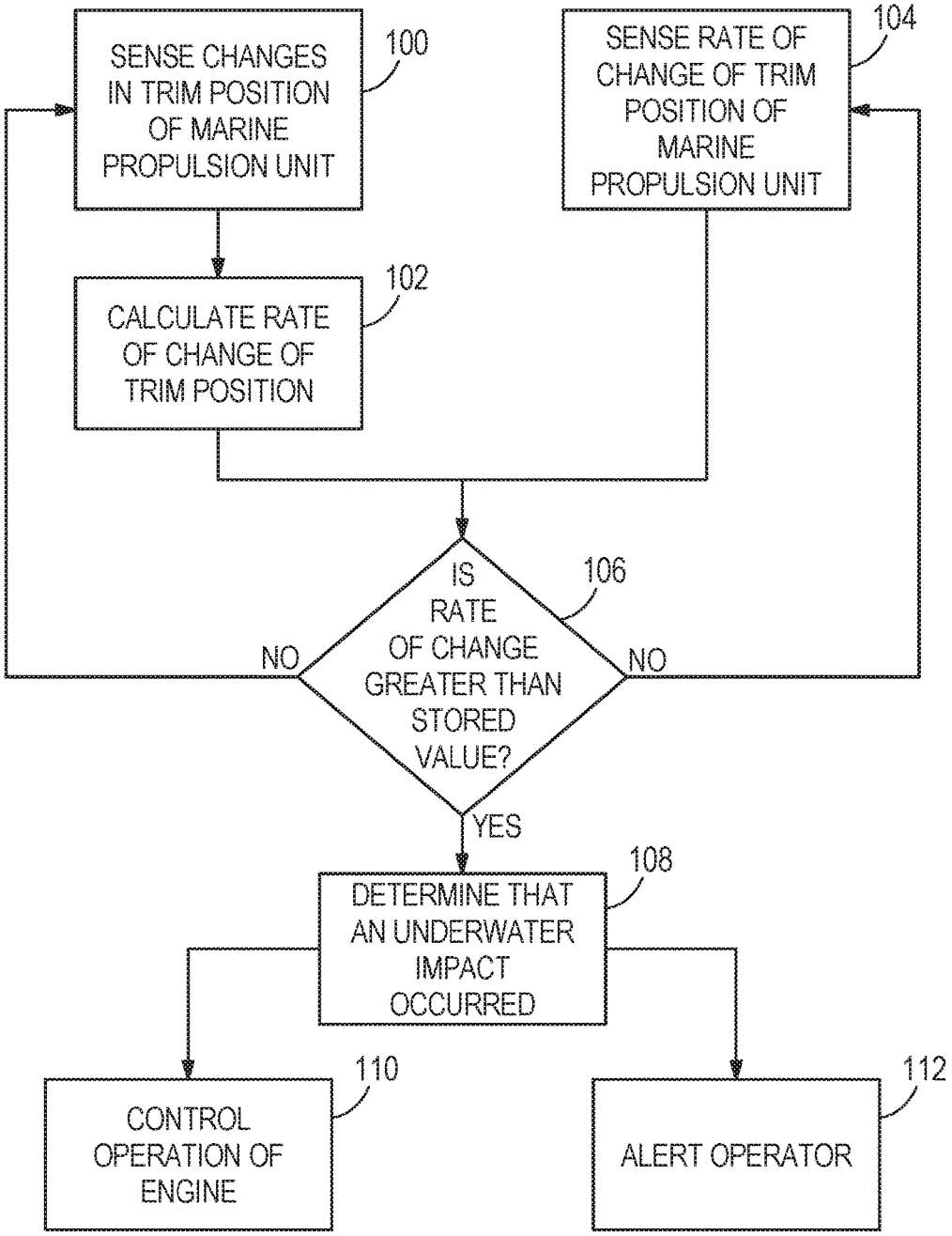
FIGS. 5-7 are flow charts that depict exemplary methods according to the present disclosure.

FIG. 5 depicts one example of a method according to the present disclosure. At step 100, the trim sensor 50 senses changes in trim position of the marine propulsion device 10, as described herein above. At step 102, the controller 36 calculates a rate of change of trim position of the marine propulsion device 10 based upon the sensed changes at step 100. Alternately, at step 104, the trim sensor 50 is configured to sense a rate of change of trim position of the marine propulsion device 10 and communicate this information to the controller 36. At step 106, the controller 36 compares the rate of change of trim position to a stored threshold value to determine whether the rate of change is greater than the stored threshold value. If no, the method repeats either step 100 or step 104. If yes, at step 108, the controller 36 is configured to determine that an underwater impact to the marine propulsion device 10 has occurred. At step 110, the controller 36 is configured to control an operation of the internal combustion engine 18, for example the ignition system 21 and/or fuel system 23 to thereby shut down the internal combustion engine 18. Optionally, at step 112, the controller 36 is configured to alert the operator regarding the impact occurrence, via for example the operator indicator device 52.

Figure 6:
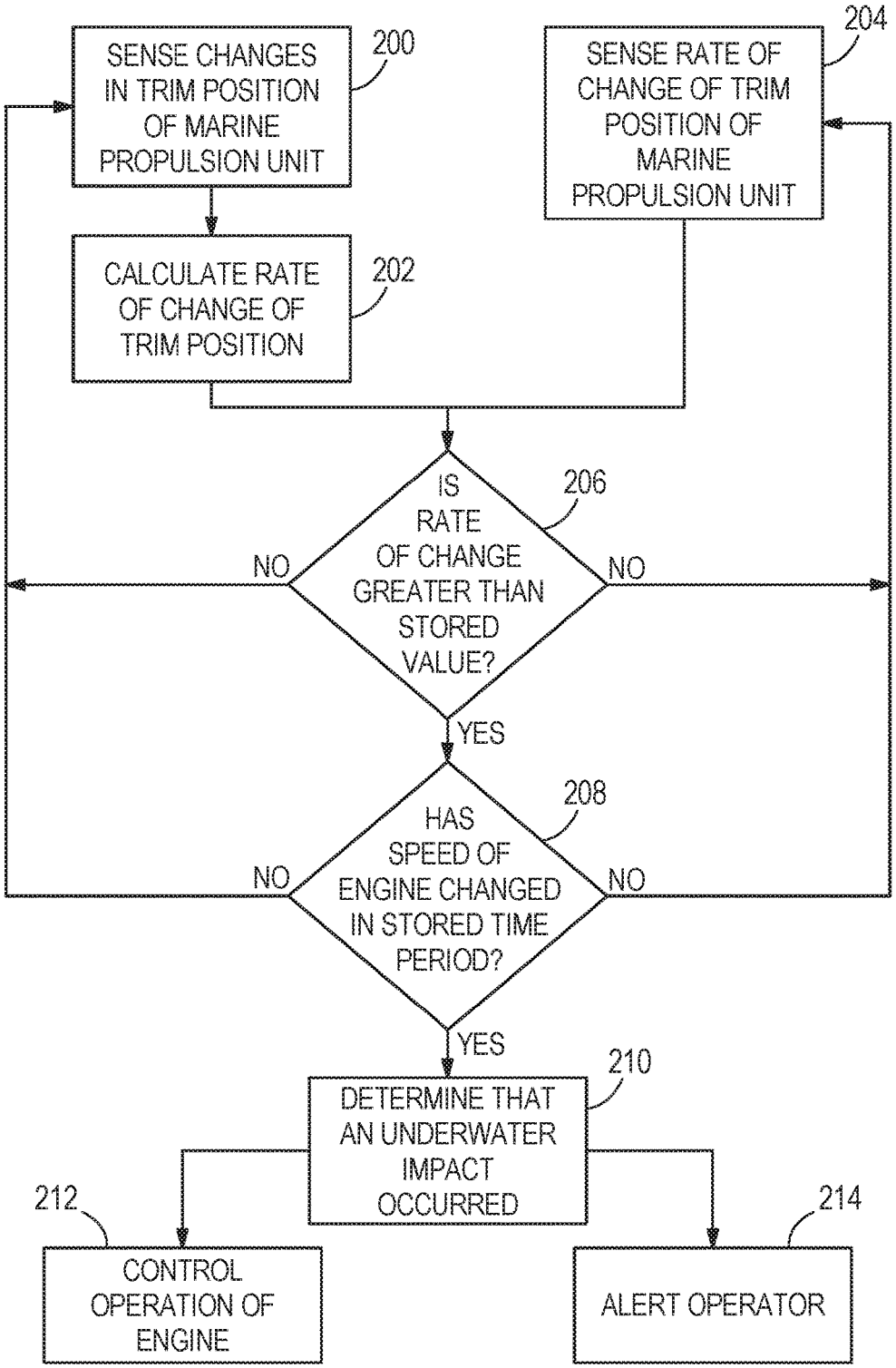

FIG. 6 depicts another example of a method according to the present disclosure. At step 200, the trim sensor 50 senses changes in trim position of the marine propulsion device 10. At step 202, the controller 36 calculates a rate of change of trim position of the marine propulsion device 10 based upon the sensed changes at step 200. Alternately, at step 204, the trim sensor 50 is configured to sense a rate of change of trim position of the marine propulsion device 10 and communicate this information to the controller 36. At step 206, the controller is configured to compare the rate of change to a stored threshold value to determine whether the rate of change is greater than the stored threshold value. If no, the method repeats steps 200 or 204. If yes, at step 208, the controller 36 determines whether the speed of the internal combustion engine 18 has changed within a stored time period from when the change in trim position of the marine propulsion device 10 occurred. The speed of the internal combustion engine 18 is sensed by the engine speed sensor 48 and communicated to the controller 36. If no, the method repeats steps 200 or 204. If yes, at step 210, the controller 36 is configured to determine that an underwater impact to the marine propulsion device 10 has occurred. At step 212, the controller 36 controls an operation of the internal combustion engine 18, such as for example shutting down the ignition system 21 and/or fuel system 23. At step 214, the controller 36 controls the operator indicator device 52 to alert the operator regarding the underwater impact.

Figure 7:
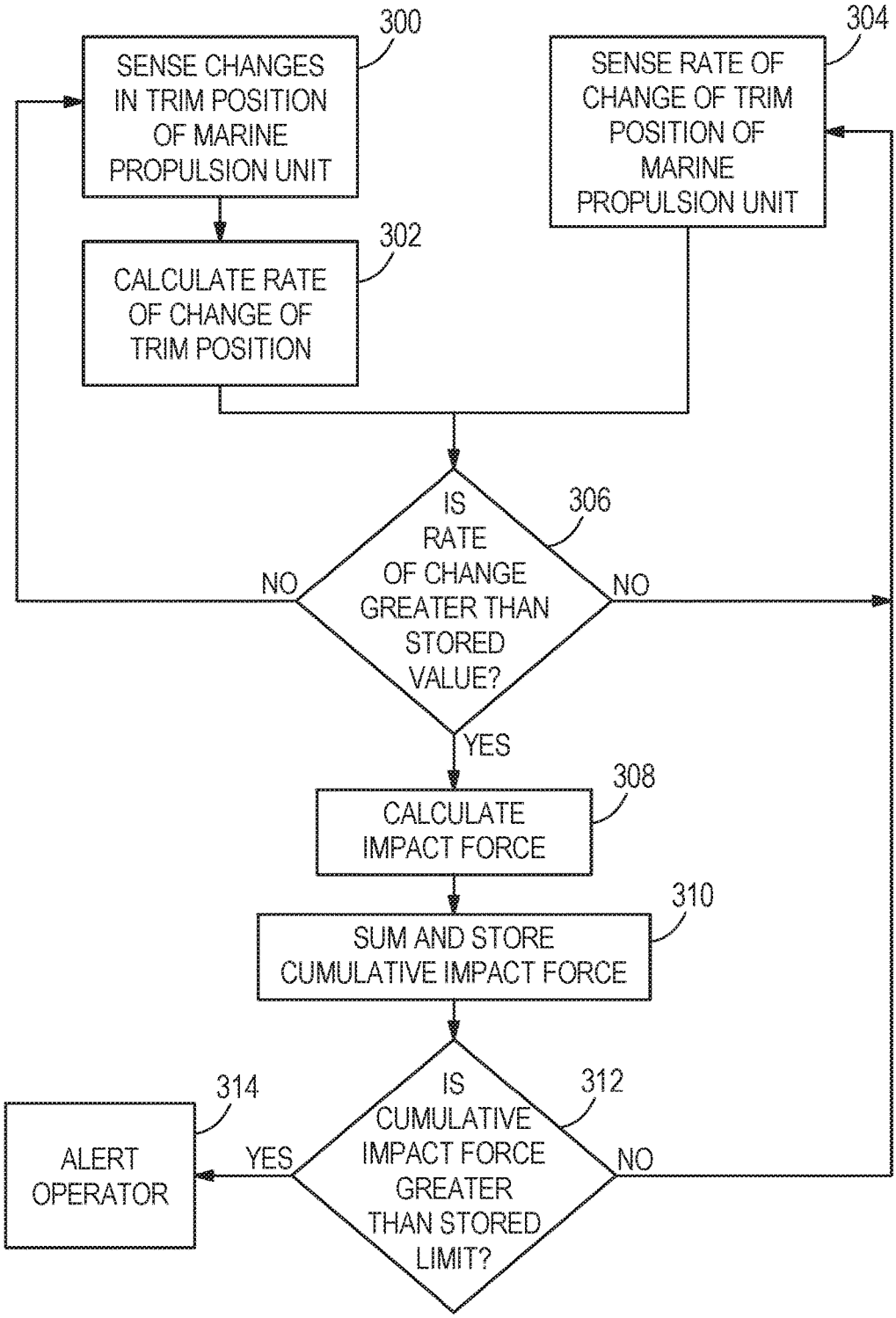

FIG. 7 depicts another example of a method according to the present disclosure. At step 300, the position sensor 50 senses changes in trim position of the marine propulsion device 10. At step 302, the controller 36 calculates the rate of change of trim position based upon the changes sensed at step 300. Alternately, at step 304, the trim sensor 50 sense the rate of change of trim position of the marine propulsion device 10 and communicates this information to the controller 36. At step 306, the controller 36 determines whether the rate of change is greater than a stored threshold value. If no, the method repeats step 300 or step 304. If yes, at step 308, the controller 36 calculates a force of impact on the marine propulsion device 10 based upon the rate of change of trim position of the marine propulsion device 10, for example by comparing the rate of change of trim position to calibrated values in a look-up table stored in the memory of the controller 36. At step 310, the controller 36 is configured to sum the force with historical forces on the marine propulsion device 10 and store this information in its memory. At step 312, the controller 36 is configured to compare the resultant sum to a stored threshold limit. As explained herein above, the controller 36 can be configured to indicate to the operator the remaining useful life of the marine propulsion device 10 based on the comparison. If the controller 36 determines that the resultant sum is greater than a stored threshold limit, at step 314, the controller 36 is configured to notify the operator via for example the operator indicator device 52. If not, the controller 36 is configured to repeat the method, beginning at step 300 or step 304. As explained herein, above, in some examples, the controller 36 can also be configured to require that the change of rate of trim occur for longer than a stored time correlated to the time a normal "trailover" event. The stored time can be a calibrated value based on trial and error and/or historical records.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A method for detecting an underwater impact to a marine propulsion device that is trimmable about a trim axis, the method comprising:

determining, with a controller, a rate at which the marine propulsion device is trimmed relative to the trim axis;

comparing, with the controller, the rate at which the marine propulsion device is trimmed relative to the trim axis to a stored threshold value to thereby determine whether an underwater impact to the marine propulsion device has occurred; and calculating, with the controller, an impact force on the marine propulsion device based upon the rate at which the marine propulsion device is trimmed relative to the trim axis.

2. The method according to claim 1, further comprising storing the impact force in a memory, summing the impact force with previous impact forces on the marine propulsion device to thereby obtain a resultant value, and comparing the resultant value to a stored threshold value to thereby determine a remaining useful life of the marine propulsion device.

3. The method according to claim 2, further comprising indicating the remaining useful life of the marine propulsion device to an operator.

4. The method according to claim 2, wherein the impact force is stored and summed by the controller only if the propulsion device is trimmed relative to the axis for a time period that is longer than a stored time period for a trailover event.

5. The method according to claim 1, further comprising summing the impact force with previous impact forces on the marine propulsion device to thereby obtain a resultant value, and comparing the resultant value to a stored threshold value to thereby determine a remaining useful life of the marine propulsion device.

6. The method according to claim 5, further comprising storing and summing the impact force only if the propulsion device is trimmed relative to the axis for a time period that is longer than a stored time period for a trailover event.

7. A method for detecting an underwater impact to a marine propulsion device that is trimmable about a trim axis, the method comprising:

determining, with a controller, a rate at which the marine propulsion device is trimmed relative to the trim axis;

comparing, with the controller, the rate at which the marine propulsion device is trimmed relative to the trim axis to a stored threshold value to thereby determine whether an underwater impact to the marine propulsion device has occurred;

modifying, with the controller, an operation of an engine associated with the marine propulsion device when the controller determines that the underwater impact to the marine propulsion device has occurred; and sensing a trim position of the marine propulsion device relative to the trim axis;

wherein the operation of the engine is modified by the controller only if the trim position of the marine propulsion device relative to the trim axis exceeds a stored trim position range.

8. The method according to claim 7, further comprising indicating to an operator that the controller has determined that the underwater impact to the marine propulsion device has occurred.

9. A method for detecting an underwater impact to a marine propulsion device that is trimmable about a trim axis, the method comprising:

determining, with a controller, a rate at which the marine propulsion device is trimmed relative to the trim axis;

comparing, with the controller, the rate at which the marine propulsion device is trimmed relative to the trim axis to a stored threshold value to thereby determine whether an underwater impact to the marine propulsion device has occurred;

shutting an operation of an engine associated with the marine propulsion device when the controller determines that the underwater impact to the marine propulsion device has occurred;

sensing a current speed of the engine;

wherein the engine is shut down only if the current speed of the engine increases within a stored time period after the marine propulsion device has been trimmed relative to the trim axis.

10. The method according to claim 9, wherein the engine is shut down via an ignition system for the engine.

11. The method according to claim 9, wherein the engine is shut down via a fuel system for the engine.

12. The method according to claim 9, further comprising indicating to an operator that the underwater impact to the marine propulsion device has occurred.

13. The method according to claim 9, further comprising sensing a trim position of the marine propulsion device relative to the trim axis, wherein the engine is shut down only if the trim position of the marine propulsion device relative to the trim axis exceeds a stored trim position range.

* * * * *